US011434887B2

(12) United States Patent
Lee et al.

(10) Patent No.: US 11,434,887 B2
(45) Date of Patent: Sep. 6, 2022

(54) LINEAR COMPRESSOR WITH SUCTION GUIDE AND SUCTION MUFFLER

(71) Applicant: LG Electronics Inc., Seoul (KR)

(72) Inventors: Kyunyoung Lee, Seoul (KR); Kiwon Noh, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 17/060,642

(22) Filed: Oct. 1, 2020

(65) Prior Publication Data

US 2021/0095656 A1 Apr. 1, 2021

(30) Foreign Application Priority Data

Oct. 1, 2019 (KR) ..... 10-2019-0121518

(51) Int. Cl.
*F04B 39/00* (2006.01)

(52) U.S. Cl.
CPC ..... *F04B 39/0088* (2013.01)

(58) Field of Classification Search
None
See application file for complete search history.

(56) References Cited

U.S. PATENT DOCUMENTS

2015/0377531 A1* 12/2015 Lee ..... F04B 39/0292 62/473
2016/0341190 A1* 11/2016 Yoo ..... F04B 39/12

FOREIGN PATENT DOCUMENTS

| | | |
|---|---|---|
| CN | 104662296 | 5/2015 |
| CN | 105298794 | 2/2016 |
| EP | 2960508 | 12/2015 |
| KR | 100292520 | 7/2000 |
| KR | 100314059 | 10/2001 |
| KR | 20060045232 | 5/2006 |
| KR | 100608858 | 8/2006 |
| KR | 100700556 | 3/2007 |
| KR | 1020160001056 | 1/2016 |
| KR | 1020190096502 | 8/2019 |

OTHER PUBLICATIONS

Extended European Search Report in EP Appln. No. 20198081.0, dated Dec. 10, 2020, 4 pages.
Korean Notice of Allowance in KR Appln. No. 2020088126117, dated Dec. 16, 2020, 4 pages (with English translation).
KR Notice of Allowance in Korean Appln. No. 10-2021-0034568, dated Apr. 22, 2021, 4 pages (with English translation).
Office Action in Chinese Appln. No. 202011015431.7, dated Apr. 2, 2022, 13 pages (with English translation).

* cited by examiner

*Primary Examiner* — Peter J Bertheaud
*Assistant Examiner* — Geoffrey S Lee
(74) *Attorney, Agent, or Firm* — Fish & Richardson P.C.

(57) ABSTRACT

A compressor includes a casing, a piston accommodated in a cylinder disposed inside the casing to reciprocate forward and backward, the piston being configured to define a suction space in which a refrigerant is accommodated therein, a suction muffler connected to the piston to guide the refrigerant to the suction space, a suction guide disposed behind the suction muffler and fixed to the casing, the suction guide being disposed parallel to the suction muffler in an axial direction, and a suction pipe passing through the casing to extend into the suction guide, the suction pipe being configured to suction the refrigerant. A portion of the suction muffler is disposed to overlap the suction guide in a direction crossing the axial direction.

19 Claims, 9 Drawing Sheets

(a)

(b)

LINEAR COMPRESSOR WITH SUCTION GUIDE AND SUCTION MUFFLER

CROSS-REFERENCE TO RELATED APPLICATION

This application is based on and claims the benefit of priority to Korean Patent Application No. 10-2019-0121518, filed on Oct. 1, 2019, in the Korean Intellectual Property Office, the disclosure of which is incorporated herein in its entirety by reference.

TECHNICAL FIELD

The present disclosure relates to a compressor. More specifically, the present disclosure relates to a linear compressor that compresses a refrigerant by a linear reciprocating motion of a piston.

BACKGROUND

In general, compressors refer to devices configured to compress a working fluid such as air or a refrigerant by receiving power from a power generating device such as a motor or a turbine. The compressors are widely applied to the whole industry or the home appliances, in particular, a steam compression refrigeration cycle (hereinafter, referred to as a 'refrigeration cycle').

The compressors are largely classified into reciprocating compressors, rotary compressors, and scroll compressors according to a manner of compressing the refrigerant.

The reciprocating compressor uses a manner in which a compression space is defined between a piston and a cylinder, and the piston linearly reciprocates to compress a fluid, the rotary compressor uses a manner in which a fluid is compressed by a roller that eccentrically rotates inside a cylinder, and the scroll compressor uses a manner in which a pair of scrolls, each of which has a spiral shape, are engaged with each other to rotate so as to compress a fluid.

Recently, among the reciprocating compressors, the use of a linear compressor using a linear reciprocating motion without a crankshaft is gradually increasing. The linear compressor has the advantage of having a relatively simple structure and improving efficiency of the compressor because there is a little mechanical loss associated with converting rotational motion to linear reciprocating motion.

In the linear compressor, a cylinder is disposed inside a casing defining a closed space to provide a compression chamber, and a piston covering the compression chamber is configured to reciprocate inside the cylinder. In the linear compressor, a fluid in the closed space is suctioned into the compression chamber while the piston is disposed at a bottom dead center (BDC), and the fluid in the compression chamber is suctioned into the compression chamber while the piston is disposed at a top dead center (TDC). Here, the processes of compressing and discharging the fluid is repeatedly performed.

The applicant has disclosed Korean Patent Publication No. 10-2019-0096502.

In the related art, a refrigerant suctioned through a suction pipe passes through a suction support plate spring support structure to move to a rear cover, and the refrigerant suctioned into a suction muffler via the rear cover moves to a suction port in front of the piston.

However, in the related art, when the refrigerant suctioned from the suction pipe passes through the suction support plate spring support structure to pass the rear cover, the refrigerant inside a shell is mixed into a space between the suction support plate spring support structure and the rear cover, and even when the refrigerant suctioned through the rear cover passes through a suction guide to move to an inlet of the suction muffler, the refrigerant inside the shell is mixed.

As described above, as the refrigerant inside the shell is mixed during the suction process, a temperature of the suction refrigerant increases to reduce compression efficiency.

PRIOR ART DOCUMENT (Patent Document 1) Korean Patent Publication No. 10-2019-0096502 A (Published, Aug. 20, 2019)

SUMMARY

Embodiments provide a compressor in which a suction structure is improved to reduce a temperature of an inlet of a suction muffler so as to prevent compression efficiency from being deteriorated due to overheating of a suction refrigerant.

Particular implementations of the present disclosure provide a compressor that includes a casing, a cylinder disposed in the casing, a piston, a suction muffler, a suction guide, and a suction pipe. The piston can be disposed in the cylinder, be configured to reciprocate in an axial direction, and define a suction space for receiving a refrigerant. The suction muffler can be connected to the piston and configured to guide the refrigerant to the suction space. The suction guide can be fixed to the casing and disposed parallel to the suction muffler in the axial direction. The suction pipe can extend through the casing into the suction guide and be configured to suction the refrigerant. At least a portion of the suction muffler can overlap with at least a portion of the suction guide in a direction that traverses the axial direction.

In some implementations, the compressor can optionally include one or more of the following features. The compressor can include a main body and a supporting spring. The main body can include the cylinder, the piston, and a driving unit that is configured to drive the piston. The support spring can support the main body. The support spring can at least partially surround the suction guide. A portion of the suction muffler can be received in the suction guide. The suction pipe can extend adjacent to an end of the suction muffler. A space can be defined between the suction guide and the suction muffler and configured to receive the refrigerant. The suction muffler can include an end portion that has an outer circumferential surface having a first diameter. The suction guide can include an opening that has an inner circumferential surface having a second diameter. The suction guide can extend in parallel with the suction muffler. The second diameter of the opening of the suction guide can be greater than the first diameter of the end portion of the suction muffler. The suction muffler can define an inlet that is configured to receive the refrigerant. The suction pipe can define an outlet that is configured to discharge the refrigerant. The inlet of the suction muffler can have an inner diameter that is greater than an outer diameter of the outlet of the suction pipe. The outlet of the suction pipe can be inserted into the suction muffler. An end of the suction pipe can be spaced apart from an end of the suction guide. The suction muffler can include an extension pipe that extends from an end of the suction muffler. The end of the suction pipe can be aligned with an end of the extension pipe or spaced apart from the end of the extension pipe. The suction guide can define a space that is configured to receive a portion of the refrigerant that is discharged from the suction pipe. Based on a suction stroke of the piston, the portion of the refrigerant within the space can be mixed with the refrigerant of the suction muffler. The suction guide can include a body portion and a fixed portion. The body portion can have a tubular shape and extend in the axial direction. The fixed portion can extend radially outward from the body portion and be fixed to the casing. The body portion can include an insulating material. The casing can include a shell and a shell cover that covers an end of the shell. The shell can receive the main body and the support spring. The shell have a cylindrical shape. The shell can define an accommodation space configured to receive a portion of the refrigerant that is discharged from the suction pipe. The suction guide can receive the refrigerant that is discharged from the suction pipe. A space can be defined between the suction guide and the suction muffler and be configured to introduce the refrigerant of the accommodation space into the suction guide. The suction guide can include a body portion and a fixed portion. The body portion can have a tubular shape and extend in the axial direction. The fixed portion can extend radially outward from the body portion and be fixed to the shell cover. The body portion can define a communication opening that fluidly communicates with the accommodation space of the shell. The communication opening can be disposed closer to the shell cover than to an end of the suction guide. The suction guide can include a valve member configured to selectively open or close the communication opening. The valve member can have (i) a first side that is coupled to an inner circumferential surface of the body portion of the suction guide around the communication opening of the body portion, and (ii) a second side that is configured to open the communication opening to guide the refrigerant of the accommodation space that is suctioned through the communication opening. The compressor can include a back cover that has (i) a first side connected to the main body and (ii) a second side that is opposite to the first side and is supported by the support spring. A through-opening can be defined in a central portion of the back cover. The suction muffler can extend through the through-opening. The suction guide can be disposed opposite to the suction space with respect to the suction muffler. The suction guide can be disposed coaxially with the suction muffler.

In one embodiment, a compressor includes: a casing; a piston accommodated in a cylinder disposed inside the casing to reciprocate forward and backward, the piston being configured to define a suction space in which a refrigerant is accommodated therein; a suction muffler connected to the piston to guide the refrigerant to the suction space; a suction guide disposed behind the suction muffler and fixed to the casing, the suction guide being disposed parallel to the suction muffler in an axial direction; and a suction pipe passing through the casing to extend into the suction guide, the suction pipe being configured to suction the refrigerant, wherein at least a portion of the suction muffler is disposed to overlap the suction guide in a direction crossing the axial direction.

The compressor may further include: a main body comprising the cylinder, the piston, and a driving unit configured to drive the piston; and a support spring configured to support one side of the main body, wherein the support spring is disposed to be supported outside the suction guide in a radial direction.

A rear portion of the suction muffler is accommodated in the suction guide so that a rear end of the suction muffler is disposed behind a front end of the suction guide.

The suction pipe may extend adjacent to a rear end of the suction muffler.

A spaced space is defined between the suction guide and the suction muffler so that the refrigerant is introduced into the spaced space.

A rear end of the suction muffler may have an outer circumferential surface with a circular shape, a front-side opening of the suction guide may have an inner circumferential surface with a circular shape, the suction guide and the suction muffler may be disposed parallel to each other with respect to the same axis, and the front-side opening of the suction guide may have an inner diameter greater than an outer diameter of a rear end of the suction muffler.

An inlet through which the refrigerant is introduced is provided in a rear portion of the suction muffler, and an outlet through which the refrigerant is discharged is provided in the suction pipe, and the inlet of the suction muffler has an inner diameter greater than an outer diameter of the outlet of the suction pipe.

The suction pipe extends forward so that the outlet of the suction pipe is inserted into the suction muffler.

A front end of the suction pipe is disposed in front of a front end of the suction guide.

The suction muffler may include an extension pipe extending forward from a rear end of the suction muffler, and the front end of the suction pipe may be disposed on the same plane as a front end of the extension pipe or may disposed in front of the front end of the extension pipe.

A space in which a portion of the refrigerant discharged from the suction pipe is stored is defined inside the suction guide, and when a suction stroke of the piston is performed, the refrigerant within the space is mixed into the refrigerant of the suction muffler.

The suction guide may include: a body portion having a tubular shape and extending in the axial direction of the suction muffler; and a fixed portion extending radially outward from a rear side of the body portion and fixed to the shell cover, wherein the body portion may include an insulating material.

The casing further comprises: a shell configured to accommodate the main body and the support spring, the shell having a cylindrical shape; and a shell cover configured to finish an end of the shell, an accommodation space inside the shell is configured to accommodate a portion of the refrigerant discharged from the suction pipe, the suction guide is filled with the refrigerant discharged from the suction pipe, and a spaced space is defined between the suction guide and the suction muffler so that the refrigerant of the accommodation space is introduced into the suction guide.

The suction guide may include: a body portion having a tubular shape and extending in the axial direction of the suction muffler; and a fixed portion extending radially outward from a rear side of the body portion and fixed to the shell cover, wherein a communication opening communicating with the accommodation space may be defined in the body portion.

The communication opening is defined adjacent to the shell cover rather than a front end of the suction guide.

The suction guide further comprises a valve member configured to selectively open or close the communication opening.

The valve member may have one side coupled to an inner circumferential surface of the body portion disposed behind the communication opening and the other side opened to guide the refrigerant of the accommodation space, which is suctioned through the communication opening, forward.

The compressor may further include a back cover having a front side connected to the main body and a rear side supported by the support spring, wherein a through-opening may be defined in a central portion of the back cover, and the suction muffler may pass through the through-opening to extend backward.

The details of one or more embodiments are set forth in the accompanying drawings and the description below. Other features will be apparent from the description and drawings, and from the claims.

DETAILED DESCRIPTION

Hereinafter, embodiments disclosed in this specification is described with reference to the accompanying drawings, and the same or corresponding components are given with the same drawing number regardless of reference number, and their duplicated description will be omitted.

In description of embodiments disclosed in this specification, it will also be understood that when an element is referred to as being "connected to" or "coupled with" another element, it can be directly connected to the other element, or intervening elements may also be present.

Moreover, In description of embodiments disclosed in this specification, detailed descriptions related to well-known functions or configurations will be ruled out in order not to unnecessarily obscure subject matters of the present disclosure. However, this does not limit the present disclosure within specific embodiments and it should be understood that the present disclosure covers all the modifications, equivalents, and replacements within the idea and technical scope of the present disclosure.

Figure 1:
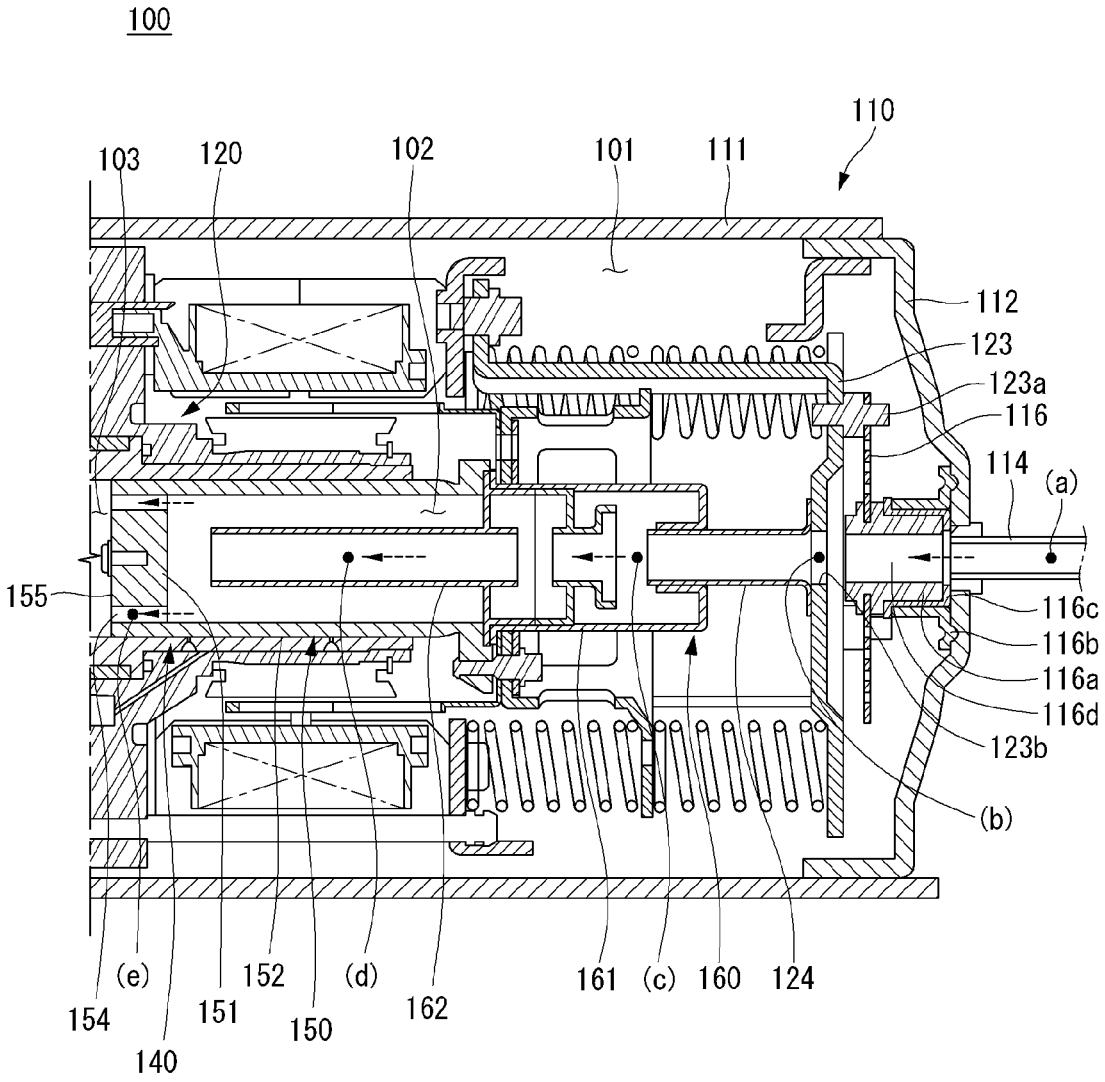
FIG. 1 is a cross-sectional view for explaining a structure of a compressor.

FIG. 1 is a cross-sectional view for explaining a structure of a compressor 100.

Hereinafter, a compressor according to an embodiment will be described with an example of a linear compressor in which a piston linearly reciprocates to suction and compress a fluid and discharge the compressed fluid.

The linear compressor may be a component of a refrigeration cycle, and the fluid compressed in the linear compressor may be a refrigerant circulating in the refrigeration cycle. In addition to the compressor, the refrigeration cycle includes a condenser, an expansion device, and an evaporator. Also, the linear compressor may be used as one component of a cooling system of a refrigerator, but is not limited thereto. For example, the linear compressor may be widely used throughout the industry.

Referring to FIG. 1, the compressor 100 may include a casing 110 and a main body accommodated in the casing 110. The main body includes a frame 120, a cylinder 140 fixed to the frame 120, a piston 150 that linearly reciprocates inside the cylinder 140, and a driving unit 130 fixed to the frame 120 to apply driving force to the piston 150.

Here, the cylinder 140 and the piston 150 may be referred to as compression units 140 and 150.

The compressor 100 may be provided with a bearing unit for reducing friction between the cylinder 140 and the piston 150. The bearing unit may be an oil bearing or a gas bearing. Alternatively, a mechanical bearing may be used as the bearing unit.

The main body of the compressor 100 may be elastically supported by support springs 116 and 117 installed at both inner ends of the casing 110. The support spring may include a first support spring 116 supporting a rear side of the main body and a second support spring 117 supporting a front side of the main body.

The support spring may be provided as a plate spring. The support springs 116 and 117 may absorb vibrations and impacts generated by the reciprocating motion of the piston 150 while supporting components provided in the body.

The casing 110 may define a closed space. The closed space includes an accommodation space 101 in which the suctioned refrigerant is accommodated, a suction space 102 filled with the refrigerant before being compressed, a compression space 103 in which the refrigerant is compressed, and a discharge space 104 filled with the compressed refrigerant.

That is, the refrigerant suctioned from a suction pipe 114 connected to a rear side of the casing 110 is filled in the accommodation space 101, and the refrigerant in the suction space 102 communicating with the accommodation space 101 is compressed in the compression space 103 and discharged to the discharge space 104. Then, the refrigerant discharged to the discharge space 104 is discharged to the outside through a discharge pipe 115 connected to a front side of the casing 110.

The casing 110 may be constituted by a shell 111 having an elongated cylindrical shape in a substantially transverse direction with both ends opened, a first shell cover 112 coupled to a rear side of the shell 111, and a second shell cover 113 coupled to a front side of the shell 111.

Here, the front side means a direction which is directed toward a left side in the drawings and in which the compressed refrigerant is discharged, and the rear side means a direction which is directed toward a right side in the drawings and into which the refrigerant is introduced.

The first shell cover 112 or the second shell cover 113 may be integrated with the shell 111.

The casing 110 may be made of a thermally conductive material. Accordingly, heat generated in the inner space of the casing 110 may be rapidly released to the outside.

The first shell cover 112 may be coupled to the shell 111 to seal a rear opening of the shell 111, and a suction pipe 114 may be inserted in a center of the first shell cover 112 so as to be coupled. The rear side of the compressor body may be elastically supported in an axial direction to the first shell cover 112 by a first support spring 116.

That is, the first shell cover 112 may be understood as a suction-side shell cover, and the first support spring 116 may be understood as a suction-side support spring.

The first support spring 116 may be provided as a circular plate spring.

An edge portion of the first support spring 116 may be supported by a back cover 123 forward through a support bracket 123*a*, and an opened central portion of the first support spring 116 may be supported by the first shell cover 112 backward through the suction guide 116*a*.

The suction guide 116*a* has a cylindrical shape, and a through-passage may be provided in the suction guide 116*a*.

A front-side circumferential surface of the suction guide 116*a* may be inserted into a central opening of the first support spring 116, and a rear end of the suction guide 116*a* may be supported by the first shell cover 112. Here, a separate suction-side support member 116*b* may be disposed between the suction guide 116*a* and an inner surface of the first shell cover 112.

The rear side of the suction guide 116*a* may communicate with the suction pipe 114. That is, the refrigerant suctioned through the suction pipe 114 may pass through the suction guide 116*a* and then be smoothly introduced into the muffler unit 160 to be described later.

A damping member 116*c* made of a rubber material or the like may be installed between the suction guide 116*a* and the suction-side support member 116*b*. Thus, vibrations that may occur while the refrigerant is suctioned through the suction pipe 114 may be prevented from being transmitted to the first shell cover 112.

The second shell cover 113 may be coupled to the shell 111 to seal the front opening of the shell 111, and the discharge pipe 115 may be inserted and coupled through a loop pipe 115*a*. The refrigerant discharged from the compression space 103 may pass through a discharge cover assembly 180 and then be discharged to the refrigeration cycle through the loop pipe 115*a* and the discharge pipe 115. The front side of the compressor body may be elastically supported by the shell 111 through the second support spring 117 in a radial direction or supported by the second shell cover 113 in an axial direction.

That is, the second shell cover 113 may be understood as a discharge-side shell cover, and the second support spring 117 may be understood as a discharge-side support spring.

The second support spring 117 may be provided as a circular plate spring. The opened central portion of the second support spring 117 may be supported by the discharge cover assembly 180 in a rear direction through a first support guide 117*b*, and the edge portion of the second support spring 117 may be supported by an inner surface of the shell 111 in the radial direction or an inner circumferential surface of the shell 11 adjacent to the second shell cover 113 through the support bracket 117*a*.

For another example, the edge portion of the second support spring 117 may be supported by the second shell cover 113 in the front direction through a bracket (not shown).

The first support guide 117*b* may have a continuous cylindrical shape having different diameters. Here, a front side of the first support guide 117*b* may be inserted into the central opening of the second support spring 117, and a rear side of the first support guide 117*b* may be inserted into the central opening of the discharge cover assembly 180. A support cover 117*c* may be coupled to the front side of the first support guide 117*b* with the second support spring 117 therebetween. Also, a cup-shaped second support guide 117*d* that is recessed forward may be coupled to the front side of the support cover 117*c*, and a cup-spaced third support guide 117*e* that is recessed backward to correspond to the second support guide 117*d* may be coupled to the inside of the second shell cover 113. The second support guide 117*d* may be inserted into the third support guide 117*e* so as to be supported in the axial direction and the radial direction. Here, a gap may be defined between the second support guide 117*d* and the third support guide 117*e*.

The frame 120 may include a body portion 121 supporting the outer circumferential surface of the cylinder 140 and a flange portion 122 connected to one side of the body portion 121 to support the driving unit 130. The frame 120 may be elastically supported together with the driving unit 130 and the cylinder 140 by the casing 110 through the first support spring 116 and the second support spring 117.

The body portion 121 may have a cylindrical shape surrounding the outer circumferential surface of the cylinder 140, and the flange portion 122 may extend from a front-side end of the body portion 121 in the radial direction.

The cylinder 140 may be coupled to an inner circumferential surface of the body portion 121, and an inner stator 134 may be coupled to an outer circumferential surface of the body portion 121. For example, the cylinder 140 may be fixed to be press-fitted to the inner circumferential surface of the body portion 121, and the inner stator 134 may be fixed using a fixing ring.

An outer stator 131 may be coupled to a rear surface of the flange portion 122, and the discharge cover assembly 180 may be coupled to a front surface of the flange portion 122. For example, the outer stator 131 and the discharge cover assembly 180 may be fixed to each other through a mechanical coupling unit.

A bearing inlet groove 125*a* constituting a portion of the gas bearing may be defined in the front surface of the flange portion 122, and a bearing communication hole 125*b* passing from the bearing inlet groove 125*a* to the inner circumferential surface of the body portion 121 may be defined. A gas groove 125*c* communicating with the bearing communication hole 125*b* may be defined in the inner circumferential surface of the body portion 121.

The bearing inlet groove 125*a* may be recessed by a predetermined depth in the axial direction, and the bearing communication hole 125*b* may be provided as a hole having a cross-sectional area less than that of the bearing inlet groove 125*a* and be inclined toward the inner circumferential surface of the body portion 121. Also, the gas groove 125*c* may has an annular shape with a predetermined depth and an axial length in the inner circumferential surface of the body portion 121. Alternatively, the gas groove 125*c* may be defined in the outer circumferential surface of the cylinder 140, which contacts the inner circumferential surface of the body portion 121, or may be defined in both the inner circumferential surface of the body portion 121 and the outer circumferential surface of the cylinder 140.

In addition, a gas inflow hole 142 corresponding to the gas groove 125*c* may be defined in the outer circumferential surface of the cylinder 140. The gas inflow hole 142 constitutes a portion of a nozzle part in the gas bearing.

Each of the frame 120 and the cylinder 140 may be made of aluminum or an aluminum alloy.

The cylinder 140 may have a cylindrical shape of which both ends are opened, the piston 150 may be inserted through a rear end of the cylinder 140, and a front end of the cylinder 140 may be closed through the discharge valve assembly 170. The compression space 103 surrounded by the cylinder 140, a front end (a head portion 151) of the piston 150, and the discharge valve assembly 170 may be defined.

The compression space 103 may increase in volume when the piston 150 moves backward, and the compression space 103 may decrease in volume when the piston 150 moves forward. That is, the refrigerant introduced into the compression space 103 may be compressed while the piston 150 moves forward and may be discharged through the discharge valve assembly 170.

A front end of the cylinder 140 may be bent outward to provide the flange portion 141. The flange portion 141 of the cylinder 140 may be coupled to the frame 120. For example, a flange groove corresponding to the flange portion 141 of the cylinder 140 may be defined in the front-side end of the frame 120, and the flange portion 141 of the cylinder 140 may be inserted into the flange groove and be coupled through the mechanical coupling member.

A gas bearing unit for gas lubrication between the cylinder 140 and the piston 150 by supplying a discharge gas into a gap between the outer circumferential surface of the piston 150 and the outer circumferential surface of the cylinder 140 may be provided. The discharge gas between the cylinder 140 and the piston 150 may provide levitation force to the piston 150 to reduce friction of the piston 150 against the cylinder 140.

For example, the gas inflow hole 142 communicating with the gas groove 125*c* defined in the inner circumferential surface of the body portion 121 to guide the compressed refrigerant, which is introduced into the gas groove 125*c* by passing through the cylinder 140 in the radial direction, to the gap between the inner circumferential surface of the cylinder 140 and the outer circumferential surface of the piston 150 may be defined in the cylinder 140. Alternatively, in consideration of convenience of processing, the gas groove 125*c* may be defined in the outer circumferential surface of the cylinder 140.

An inlet of the gas inflow hole 142 may be relatively wide, and an outlet of the gas inflow hole 142 may be provided as a fine hole to serve as a nozzle. A filter (not shown) may be additionally provided at the inlet of the gas inflow hole 142 to block an inflow of foreign substances. The filter may be a mesh filter made of metal or may be provided by winding a member such as a fine thread.

A plurality of gas inflow holes 142 may be independently defined. Alternatively, an inlet of the gas inflow hole 142 may be provided as an annular groove, and a plurality of outlets of the gas inflow hole 142 may be defined along the annular groove at a predetermined interval.

Also, the gas inflow hole 142 may be defined only at the front side with respect to a middle of the axial direction of the cylinder 140 or may be defined at the rear side in consideration of drooping of the piston 150.

The piston 150 is inserted into the opened end of the rear side of the cylinder 140 and is provided to seal the rear side of the compression space 103.

The piston 150 includes a head portion 151 that divides the compression space 103 in a disk shape and a cylindrical guide portion 152 extending backward from an outer circumferential surface of the head portion 151. The head portion 151 is provided to be partially opened, the guide portion 152 is empty therein, and a front portion of the guide portion 152 is partially sealed by the head portion 151. However, a rear side of the guide portion 152 is connected to the muffler unit 160. The head portion 151 may be provided as a separate member coupled to the guide portion 152, or the head portion 151 and the guide portion 152 may be integrated with each other.

A suction port 154 is provided to pass through the head portion 151 of the piston 150. The suction port 154 is provided to communicate with the suction space 102 and the compression space 103 inside the piston 150. For example, the refrigerant introduced from the accommodation space 101 to the suction space 102 inside the piston 150 may pass through the suction port 154 to pass through the compression space 103 between the piston 150 and the cylinder 140.

The suction port 154 may extend in the axial direction of the piston 150. Alternatively, the suction port 154 may be provided to be inclined in the axial direction of the piston 150. For example, the suction port 154 may extend to be inclined in a direction away from a central axis toward the rear side of the piston 150.

The suction port 154 may have a circular cross-sectional area and a constant inner diameter. Alternatively, the suction port 154 may be provided as a long hole of which an opening extends in a radial direction of the head portion 151 or may be provided so that the inner diameter gradually increases toward the rear side.

The suction port 154 may be provided in plurality in one or more directions of a radial direction and a circumferential direction of the head portion 151.

Also, a suction valve 155 for selectively opening or closing the suction port 154 may be mounted on the head portion 151 of the piston 150 adjacent to the compression space 103. The suction valve 155 may operate by elastic deformation to open or close the suction port 154. That is, the suction valve 155 may be elastically deformed to open the suction port 154 by a pressure of the refrigerant flowing through the suction port 154 to flow to the compression space 103.

Also, the piston 150 is connected to a mover 135, and the mover 135 reciprocates in a front and rear direction according to the movement of the piston 150. The inner stator 134 and the cylinder 140 may be disposed between the mover 135 and the piston 150. Also, the mover 135 and the piston 150 may be connected to each other by a magnet frame 136 provided by bypassing the cylinder 140 and the inner stator 134 backward.

The muffler unit 160 is coupled to the rear side of the piston 150 and is provided to attenuate noise generated during the process of suctioning the refrigerant into the piston 150. The refrigerant suctioned through the suction pipe 114 flows into the suction space 102 of the piston 150 through the muffler unit 160.

The muffler unit 160 includes a suction muffler 161 communicating with the accommodation space 101 of the casing 110 and an inner guide 162 connected to a front side of the suction muffler 161 to guide the refrigerant to the suction port 154.

The suction muffler 161 may be disposed behind the piston 150. Here, a rear-side opening of the suction muffler 161 may be disposed adjacent to the suction pipe 114, and a front end of the suction muffler 161 may be coupled to the rear side of the piston 150. The suction muffler 161 has a flow passage provided in the axial direction and may guide the refrigerant in the accommodation space 101 to the suction space 102 of the piston 150.

Here, a plurality of noise spaces divided by baffles may be defined inside the suction muffler 161. The suction muffler 161 may be provided by coupling two or more members to each other. For example, a second suction muffler may be press-fitted inside a first suction muffler to define the plurality of noise spaces. Also, the suction muffler 161 may be made of a plastic material in consideration of weight or insulation.

The inner guide 162 may have a pipe shape of which one side communicates with the noise space of the suction muffler 161, and the other side is deeply inserted into the piston 150. The inner guide 162 may have a cylindrical shape of which both ends are provided with the same inner diameter. However, in some cases, an inner diameter of a front end, which is a discharge-side, may be greater than that of a rear end which is an opposite side of the front end.

The suction muffler 161 and the inner guide 162 may be provided in various shapes to control a pressure of the refrigerant passing through the muffler unit 160. The suction muffler 161 and the inner guide 162 may be integrated with each other.

The discharge valve assembly 170 may include a discharge valve 171 and a valve spring 172 provided at a front side of the discharge valve 171 to elastically support the discharge valve 171. The discharge valve assembly 170 may selectively discharge the refrigerant compressed in the compression space 103. Here, the compression space 103 may be understood as a space defined between the suction valve 155 and the discharge valve 171.

The discharge valve 171 may be disposed to be supported on a front surface of the cylinder 140 and may be mounted to selectively open or close the front opening of the cylinder 140. The discharge valve 171 may operate by elastic deformation to open or close the compression space 103. The discharge valve 171 may be elastically deformed to open the compression space 103 by the pressure of the refrigerant flowing into the discharge space 104 through the compression space 103. For example, while the discharge valve 171 is supported on the front surface of the cylinder 140, the compression space 103 may be maintained in the closed state, and the discharge valve 171 may discharge the compressed refrigerant of the compression space 103 into the opened space in a state of being spaced apart from the front surface of the cylinder 140.

The valve spring 172 is provided between the discharge valve 171 and the discharge cover assembly 180 to provide elastic force in the axial direction. The valve spring 172 may be provided as a compression coil spring or may be provided as a plate spring in consideration of an occupied space or reliability.

When a pressure in the compression space 103 is greater than or equal to the discharge pressure, the valve spring 172 is deformed forward to open the discharge valve 171, and the refrigerant is discharged from the compression space 103 and then discharged into the first discharge space 103*a* of the discharge cover assembly 180. Also, when the discharge of the refrigerant is completed, the valve spring 172 provides restoring force to the discharge valve 171 so that the discharge valve 171 is closed.

A process in which the refrigerant is introduced into the compression space 103 through the suction valve 155, and the refrigerant in the compression space 103 is discharged to the discharge space 104 through the discharge valve 171 will be described as follows.

In the process in which the piston 150 linearly reciprocates inside the cylinder 140, when the pressure in the compression space 103 is equal to or less than a predetermined suction pressure, the suction valve 155 is opened, and the refrigerant is suctioned into the compression space 103. On the other hand, when the pressure in the compression space 103 exceeds the predetermined suction pressure, the refrigerant in the compression space 103 is compressed in the state in which the suction valve 155 is closed.

On the other hand, when a pressure in the compression space 103 is greater than or equal to a predetermined discharge pressure, the valve spring 172 is deformed forward to open the discharge valve 171, and the refrigerant is discharged from the compression space 103 to the discharge space 104 of the discharge cover assembly 180. When the discharge of the refrigerant is completed, the valve spring 172 provides restoring force to the discharge valve 171, and the discharge valve 171 is closed to seal the front side of the compression space 103.

The discharge cover assembly 180 is installed in front of the compression space 103 to define the discharge space 104 in which the refrigerant discharged from the compression space 103 is accommodated and then is coupled to the front side of the frame 120 to allow noise of the refrigerant, which is generated while the refrigerant is discharged from the compression space 103 to being attenuated. The discharge cover assembly 180 may be coupled to the front side of the flange portion 122 of the frame 120 while accommodating the discharge valve assembly 170. For example, the discharge cover assembly 180 may be coupled to the flange portion 122 through the mechanical coupling member.

Also, a gasket 165 for insulation and an O-ring for suppressing leakage of the refrigerant of the discharge space 104 may be provided between the discharge cover assembly 180 and the frame 120.

The discharge cover assembly 180 may be made of a thermally conductive material. Thus, when a high-temperature refrigerant is introduced into the discharge cover assembly 180, heat of the refrigerant may be transferred to the casing 110 through the discharge cover assembly 180 and then be released to the outside of the compressor.

The discharge cover assembly 180 may be provided as one discharge cover, or a plurality of discharge covers may be disposed to sequentially communicate with each other. When the plurality of discharge covers are provided, the discharge space 104 may include a plurality of space portions partitioned by each of the discharge covers. The plurality of space portions are arranged in the front-rear direction to communicate with each other.

For example, when three discharge covers are provided, the discharge space 104 may include a first discharge space 103*a* defined between a first discharge cover 181 coupled to a front-side of the frame 120 and may the frame 120, a second discharge space 103*b* defined between a second discharge cover 182 communicating with the first discharge space 103*a* and coupled to a front-side of the first discharge cover 181 and the first discharge cover 181, and a third discharge space 103*c* defined between a third discharge cover 183 communicating with the second discharge space 103*b* and coupled to a front-side of the second discharge cover 182 and the second discharge cover 182.

The first discharge space 103*a* may selectively communicate with the compression space 103 by the discharge valve 171, the second discharge space 103*b* may communicate with the first discharge space 103*a*, and the third discharge space 103*c* may communicate with the second discharge space 103*b*. Thus, the refrigerant discharged from the compression space 103 may sequentially pass through the first discharge space 103*a*, the second discharge space 103*b*, and the third discharge space 103*c* and thus be attenuated in discharge noise and then may be discharged to the outside of the casing 110 through the loop pipe and the discharge pipe 115, which communicate with the third discharge cover 813.

The driving unit 130 includes an outer stator 131 disposed between the shell 111 and the frame 120 to surround the body portion 121 of the frame 120, an inner stator 134 disposed between the outer stator 131 and the cylinder 140 to surround the cylinder 140, and a mover 135 disposed between the outer stator 131 and the inner stator 134.

The outer stator 131 may be coupled to the rear side of the flange portion 122 of the frame 120, and the inner stator 134 may be coupled to the outer circumferential surface of the body portion 121 of the frame 120. The inner stator 134 may be spaced inward from the outer stator 131, and the mover 135 may be disposed in a space between the outer stator 131 and the inner stator 134.

A winding coil may be mounted on the outer stator 131, and the mover 135 may be provided with a permanent magnet. The permanent magnet may be provided as a single magnet having one pole or may be provided as a combination of a plurality of magnets having three poles.

The outer stator 131 includes a coil winding body 132 surrounding the axial direction in the circumferential direction and a stator core 133 stacked while surrounding the coil winding body 132. The coil winding body 132 may include a hollow bobbin 132*a* having a cylindrical shape and a coil 132*b* wound in the circumferential direction of the bobbin 132*a*. A cross-section of the coil 132*b* may have a circular or polygonal shape, and for example, may have a hexagonal shape. In the stator core 133, a plurality of lamination sheets may be radially stacked, or a plurality of lamination blocks may be stacked along a circumferential direction.

A front-side of the outer stator 131 may be supported by the flange portion 122 of the frame 120, and a rear-side of the outer stator 131 may be supported by the stator cover 137. For example, the stator cover 137 may be provided in the form of a hollow disk, the outer stator 131 may be supported on a front surface of the stator cover 137, and a resonance spring 190 may be supported on a rear surface of the stator cover 137.

The inner stator 134 may be configured by stacking a plurality of laminations on the outer circumferential surface of the body portion 121 of the frame 120 in the circumferential direction.

One side of the mover 135 may be coupled to and supported by the magnet frame 136. The magnet frame 136 has a substantially cylindrical shape and is disposed to be inserted into a space between the outer stator 131 and the inner stator 134. The magnet frame 136 is coupled to the rear side of the piston 150 and is provided to move together with the piston 150.

For example, a rear end of the magnet frame 136 may be bent to extend inward in the radial direction to provide a coupling portion 136*a*, and the coupling portion 136*a* may be coupled to the flange portion 153 disposed behind the piston 150. The coupling portion 136*a* of the magnet frame 136 and the flange portion 153 of the piston 150 may be coupled to each other through the mechanical coupling member.

Furthermore, the flange portion 161*a* disposed in front of the suction muffler 161 may be disposed between the flange portion 153 of the piston 150 and the coupling portion 136*a* of the magnet frame 136. Thus, the piston 150, the muffler unit 160, and the mover 135 may linearly reciprocate together in a state of being integrally coupled to each other.

When current is applied to the driving unit 130, a magnetic flux is generated in the winding coil, and electromagnetic force may be generated by an interaction between the magnetic flux generated in the winding coil of the outer stator 131 and the magnetic flux generated by a permanent magnet of the mover 135 may be generated to allow the mover 135 to move. While the axial reciprocation movement of the mover 135 is performed, the piston 150 connected to the magnet frame 136 may also reciprocate in the axial direction by being integrated with the mover 135.

The driving unit 130 and the compression units 140 and 150 may be supported in the axial direction by the support springs 116 and 117 and the resonance spring 190.

The resonance spring 118 may amplify the vibration implemented by the reciprocating motion of the mover 135 and the piston 150 to effectively compress the refrigerant. Particularly, the resonance spring 118 may be adjusted to a frequency corresponding to the natural frequency of the piston 150 so that the piston 150 performs a resonant motion. Also, the resonance spring 118 may cause a stable movement of the piston 150 to reduce the vibration and the noise generation.

The resonance spring 118 may be a coil spring extending in the axial direction. Both ends of the resonance spring 118 may be connected to a vibration body and a fixed body, respectively. For example, one end of the resonance spring 118 may be connected to the magnet frame 136, and the other end of the resonance spring 118 may be connected to the back cover 123. Thus, the resonance spring 118 may be elastically deformed between the vibration body vibrating at one end thereof and the fixed body fixed to the other end thereof.

The natural frequency of the resonance spring 118 is designed to match the resonance frequency of the mover 135 and the piston 150 when the compressor 100 operate so that the reciprocating motion of the piston 150 is amplified. However, since the back cover 123 provided as the fixed body is elastically supported to the casing 110 through the first support spring 116, the back cover 123 may not be strictly fixed.

The resonance spring 118 may include a first resonance spring 118*a* supported on a rear-side thereof and a second resonance spring 118*b* supported on a front side thereof with respect to the spring support 119.

The spring support 119 includes a body portion 119*a* surrounding the suction muffler 161, a coupling portion 119*b* bent from a front side of the body portion 119*a* in an inner radial direction, and a support 119*c* bent from a rear side of the body portion 119*a* in an outer radial direction.

A front surface of the coupling portion 119*b* of the spring support 119 may be supported by the coupling portion 136*a* of the magnet frame 136. An inner diameter of the coupling portion 119*b* of the spring support 119 may be provided to surround an outer diameter of the suction muffler 161. For example, the coupling portion 119*b* of the spring support 119, the coupling portion 136*a* of the magnet frame 136, and the flange portion 153 of the piston 150 may be sequentially disposed and then integrated with each other through the mechanical member. Here, as described above, the flange portion 161*a* of the suction muffler 161 may be disposed between the flange portion 153 of the piston 150 and the coupling portion 136*a* of the magnet frame 136 and thus may be fixed together.

The first resonance spring 118*a* may be provided between a front surface of the back cover 123 and a rear surface of the spring support 119, and the second resonance spring 118*b* may be provided between a rear surface of the stator cover 137 and a front surface of the spring support 119.

A plurality of first and second resonance springs 118*a* and 118*b* may be disposed in a circumferential direction of a central axis. The first resonance spring 118*a* and the second resonance spring 118*b* may be disposed parallel to each other in the axial direction or may be disposed to be alternated with respect to each other.

The first and second springs 118*a* and 118*b* may be disposed at regular intervals in the radial direction of the central axis. For example, each of the first and second springs 118*a* and 118*b* may be provided in three and may be disposed at intervals of about 120 degrees in a radial direction of the central axis.

The compressor 100 may include a plurality of sealing members that are capable of increasing in coupling force between the frame 120 and components around the frame 120.

For example, the plurality of sealing members may include a first sealing member disposed into a portion at which the frame 120 and the discharge cover assembly 180 are coupled to each other and inserted into an installation groove defined in a front end of the frame 120 and a second sealing member provided at a portion at which the frame 120 and the cylinder 140 are coupled to each other and inserted into an installation groove defined in an outer surface of the cylinder 140. The second sealing member may prevent the refrigerant in the gas groove 125*c* defined between the inner circumferential surface of the frame 120 and the outer circumferential surface of the cylinder 140 from leaking to the outside and improve the coupling force between the frame 120 and the cylinder 140.

The plurality of sealing members may further include a third sealing member provided at a portion at which the frame 120 and the inner stator 134 are coupled to each other and inserted into an installation groove defined in an outer surface of the frame 120. Here, each of the first to third sealing members may have a ring shape.

The operation of the linear compressor 100 described above is as follows.

First, when current is applied to the driving unit 130, a magnetic flux may be generated in the outer stator 131 by the current flowing through the coil 132*b*. The magnetic flux generated in the outer stator 131 may generate electromagnetic force, and the mover 135 provided with the permanent magnet may linearly reciprocate by the generated electromagnetic force. The electromagnetic force may be alternately generated in a direction (forward direction) in which the piston moves toward a top dead center (TDC) during a compression stroke and may be generated in a direction (backward direction) in which the piston moves toward a bottom dead center (BDC) during a suction stroke. That is, the driving unit 130 may generate propulsion force, which is force that pushes the mover 135 and the piston 150 in the moving direction.

The piston 150 linearly reciprocating inside the cylinder 140 may repeatedly increase and decrease in volume of the compression space 103.

When the piston 150 moves in a direction (backward direction) in which the volume of the compression space 103 increases, the pressure in the compression space 103 decreases. Here, the suction valve 155 mounted at the front side of the piston 150 may be opened, and the refrigerant remaining in the suction space 102 may be suctioned into the compression space 103 along the suction port 154. The suction stroke may proceed until the piston 150 maximizes the volume of the compression space 103 and is disposed at the bottom dead center.

The piston 150 reaching the bottom dead center may be converted in moving direction to perform the compression stroke while moving in the direction (forward direction) in which the volume of the compression space 103 decreases. During the compression stroke, the suctioned refrigerant is compressed while the pressure in the compression space 103 increases. When the pressure in the compression space 103 reaches a set pressure, the discharge valve 171 is pushed by the pressure in the compression space 103 and then is opened from the cylinder 140, and the refrigerant is discharged through the spaced space. The compression stroke continues while the piston 150 moves to the top dead center at which the volume of the compression space 103 is minimized.

As the suction stroke and the compression stroke of the piston 150 are repeated, the refrigerant introduced into the accommodation space 101 inside the compressor 100 through the suction pipe 114 sequentially passes through the suction guide 116*a*, the suction muffler 161, and the inner guide 162 and is introduced into the suction space 102, and the refrigerant of the suction space 102 is introduced into the compression space 103 inside the cylinder during the suction stroke of the piston 150. Also, after the refrigerant in the compression space 103 is compressed and discharged to the discharge space 104 during the compression stroke of the piston 150, the refrigerant may pass through the loop pipe 115*a* and the discharge pipe 115 to flow to the outside of the compressor 100.

Figure 2:
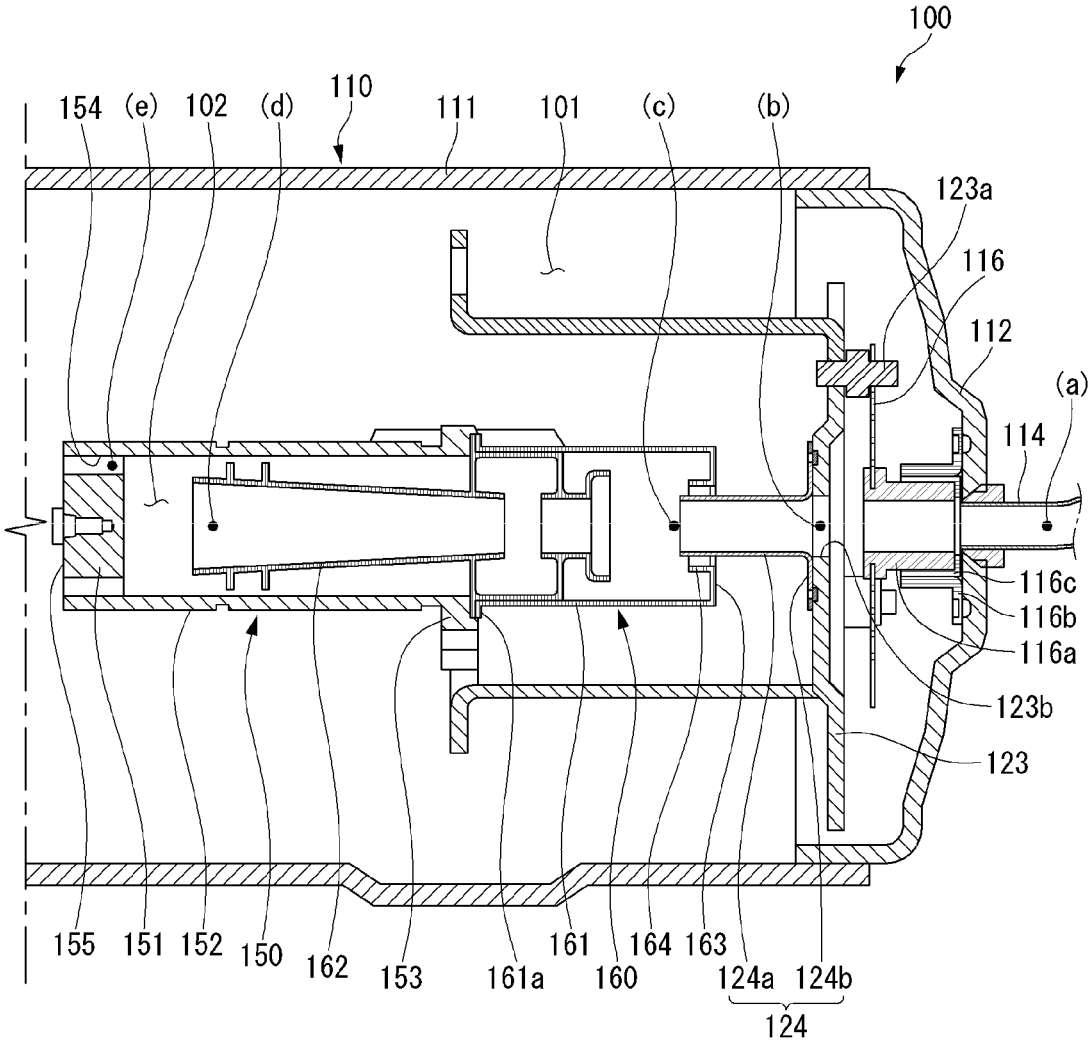
FIG. 2 is a cross-sectional view illustrating a suction structure of a compressor according to Comparative Example.

FIG. 2 is a cross-sectional view illustrating a suction structure of the compressor 100 according to Comparative Example.

Referring to FIG. 2, in the compressor 100 according to Comparative Example, the refrigerant suctioned through the suction pipe 114 passes through the central opening 123*b* of the back cover 123 via the through-passage of the suction guide 116*a* and then is introduced into the suction muffler 161 via a connection guide 124 disposed between the back cover 123 and the suction muffler 161, is introduced into the suction space 102 via the suction muffler 161 and the inner guide 162, and is discharged to the compression space 103 via the suction port 154.

A rear end of the suction guide 116*a* is supported on the first shell cover 112 by the suction-side support member 116*b*, and an outer circumferential surface of a front end of the suction guide 116*a* is coupled to the first support spring 116. Here, the front end of the suction guide 116*a* is disposed to be spaced apart from the back cover 123, and a first communication passage communicating with the accommodation space 101 inside the casing 110 may be provided between the opening of the back cover 123 and the through-passage of the suction guide 116*a*.

Thus, while the refrigerant is introduced into the connection guide 124 through the suction guide 116*a*, the refrigerant accommodated in the accommodation space 101 is introduced through the first communication passage between the back cover 123 and the suction guide 116*a*.

A rear end of the connection guide 124 may be supported by the back cover 123, and a front end of the connection guide 124 may be accommodated in an opening of a rear end of the suction muffler 161. Here, the connection guide 124 has an outer diameter less than an inner diameter of the opening of the rear end of the suction muffler 161, and a second communication passage communicating with the accommodation space 101 inside the casing 110 is provided between an outer circumferential surface of the connection guide 124 and an inner circumferential surface of the rear end of the suction muffler 161.

Thus, while the refrigerant is introduced into the suction muffler 161 through the connection guide 124, the refrigerant accommodated in the accommodation space 101 is introduced through the second communication passage between the connection guide 124 and the suction muffler 161.

As described above, while the refrigerant suctioned through the suction pipe 114 moves to the suction space 102 inside the piston 150, when the refrigerant accommodated in the accommodation space 101 inside the shell 111 is mixed, a temperature of the refrigerant may increase. Thus, when the refrigerant accommodated in the suction space 102 increases in temperature, compression efficiency may be deteriorated.

The refrigerant accommodated in the accommodation space 101 inside the shell 111 increases in temperature by heat generated from the compression unit and the driving unit. Thus, the temperature of the refrigerant accommodated in the accommodation space 101 is higher than that of the refrigerant suctioned through the suction pipe 114.

When the refrigerant that is in a gaseous state is suctioned through the suction pipe 114, if the temperature of the refrigerant gas accommodated in the suction space 102 increases, only a relatively small amount of refrigerant gas may be accommodated compared to an amount of refrigerant gas when the temperature of the refrigerant gas is low. This is because in the case of a gas, a large volume difference occurs depending on the temperature.

Thus, when the temperature of the refrigerant in the suction space 102 increases, a mass of the refrigerant compressed during one compression stroke decreases, resulting in a limitation of lowering the compression efficiency.

Figure 3:
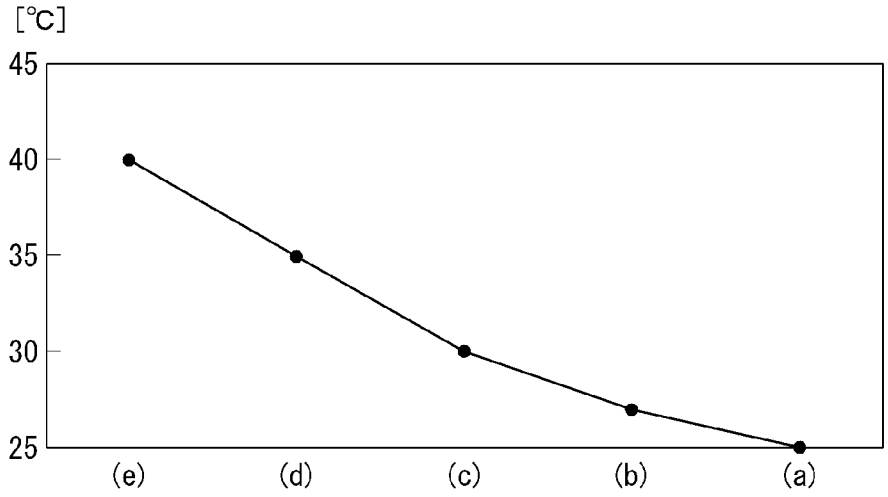
FIG. 3 is a view illustrating a temperature path of a refrigerant suctioned in FIG. 2.

FIG. 3 is a view illustrating a temperature path of the refrigerant suctioned in FIG. 2.

Referring to FIG. 3, a refrigerant gas (point a in FIG. 2) in the suction pipe 114 is suctioned at a temperature of about degrees, and the refrigerant gas inside the accommodation space is mixed through the first communication passage at an outlet portion (point b in FIG. 2) of the suction guide 116*a*, and thus, the temperature of the refrigerant gas increases to about 27 degrees. Also, the refrigerant gas inside the accommodation space 101 is mixed through the second communication passage at an outlet portion (point c in FIG. 2) of the connection guide 124, and thus, the temperature of the refrigerant gas increases to about 30 degrees. Also, the temperature of the refrigerant gas increases to about 35 degrees while passing through the suction muffler 161 and the inner guide 162 (point d of FIG. 2), and also, when passing through the suction port 154 (point e of FIG. 2), the temperature of the refrigerant gas increases to about 40 degrees.

Figure 4:
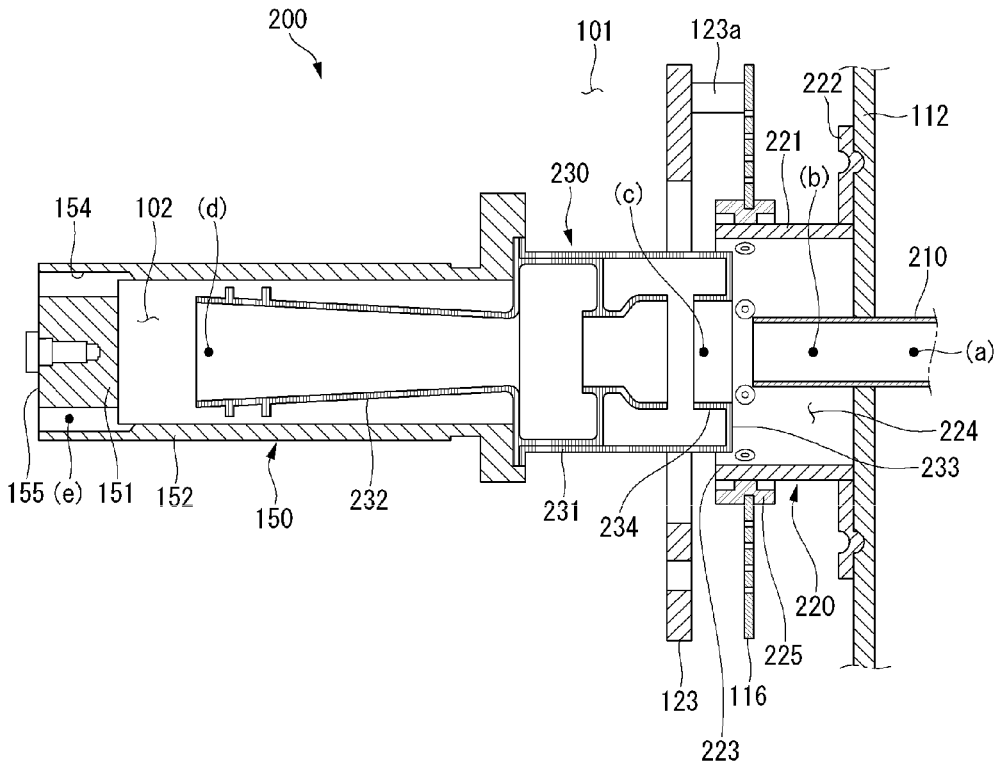
FIG. 4 is a cross-sectional view illustrating a suction structure of a compressor according to an embodiment.
Figure 5:
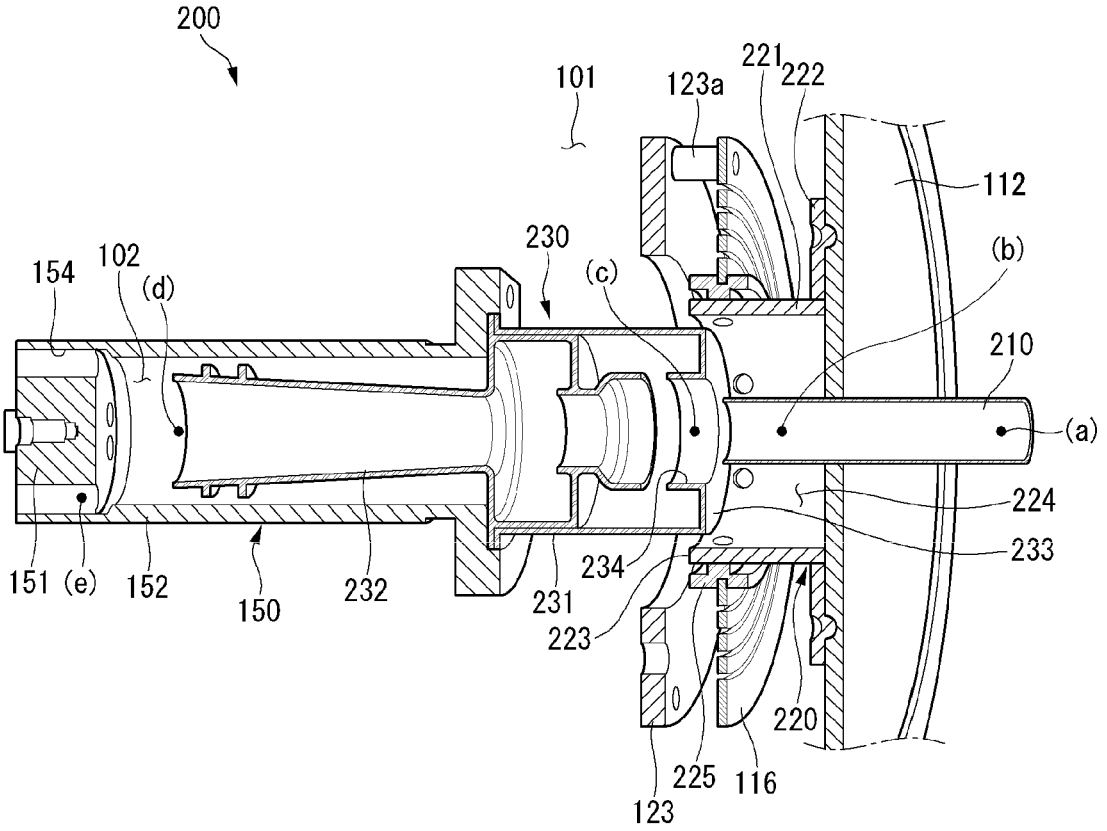
FIG. 5 is a perspective view of FIG. 4.

FIG. 4 is a cross-sectional view illustrating a suction structure 200 of the compressor according to an embodiment, and FIG. 5 is a perspective view of FIG. 4.

Referring to FIGS. 4 and 5, the suction structure 200 according to a first embodiment includes a suction pipe 210 passing through a first shell cover 112 and a suction guide 220 fixed to the inside of the first shell cover 112 to accommodate a suction pipe 210 therein and support a first support spring 116.

Also, the suction structure 200 according to the first embodiment includes a suction muffler 230 disposed in front of the suction guide 220 and a piston 150 defining a suction space 102 in which a refrigerant gas introduced through the suction muffler 230 is accommodated.

The suction pipe 210 may pass through a center of the first shell cover 112 to extend forward from the inside of the suction guide 220.

The suction guide 220 may include a body portion 221 accommodating the suction pipe 210 therein and a fixed portion 222 extending radially outward from a rear side of the body portion 221.

The fixed portion 222 may be fixed to the first shell cover 112.

For example, the fixed portion 222 may be fixed by contacting an inner surface of the first shell cover 112.

A first support spring 116 may be supported on an outer circumferential surface of the body portion 221. The first support spring 116 may be disposed in front of the fixed portion 222.

For example, the first support spring 116 may be disposed closer to a front end 223 than a rear end of the outer circumferential surface of the body portion 221.

A space 224 in which the refrigerant is stored may be defined inside the suction guide 220. Here, a portion of the suction pipe 210 may be disposed inside the space 224 so that the suction pipe 210 communicates with the space 224.

That is, a portion of the refrigerant passing through the suction pipe 210 may flow through the space 224. A connection member 225 having an annular shape is disposed between the first support spring 116 and the suction guide 220.

A groove which has an annular shape and into which an inner circumferential surface of the first support spring 116 is fitted may be defined in the outer circumferential surface of the connection member 225. The inner circumferential surface of the connecting member 225 may be coupled in close contact with the outer circumferential surface of the body portion 221 of the suction guide 220.

Also, the connecting member 225 may perform a buffer function to relieve vibration and impact between the first support spring 116 and the suction guide 220. For this, the connection member 225 may be made of a material capable of elastic deformation.

The suction muffler 230 may be disposed in front of the suction guide 220 and may provide a passage through which the refrigerant gas suctioned through the suction pipe 210 is introduced.

The suction muffler 230 includes an outer guide 231 coupled to the outside of the piston 150 and an inner guide 232 extending in an axial direction along the inside of the piston 150 from a front side of the outer guide 231.

A portion of the suction muffler 230 may be disposed to overlap the suction guide 220 in a direction crossing the axial direction. In detail, a rear portion of the suction muffler 230 may overlap a front portion of the suction guide 220 in a radial direction.

An outer diameter of the rear portion of the suction muffler 230 may be less than an inner diameter of the suction guide 220. Thus, at least a portion of the rear portion of the suction muffler 230 may be inserted into the suction guide 220.

In other words, at least a portion of the rear portion of the suction muffler 230 may be disposed to overlap the front portion of the suction guide 220 in the radial direction inside the suction guide 220.

That is, a rear end 233 of the suction muffler 230 may be disposed behind a front end 223 of the suction guide 220.

Here, an annular tolerance may occur between the suction muffler 230 and the suction guide 220. The tolerance may be determined in consideration of a design tolerance and an assembly tolerance. The rear end of the suction muffler 230 may have an outer circumferential surface in a circular shape, and an inner circumferential surface of a front opening of the suction guide 220 may have a circular shape.

An inner diameter of a front-side opening of the suction guide 220 may be greater than an outer diameter of a rear end of the suction muffler 230.

The refrigerant gas suctioned through the suction pipe 210 may be introduced into the suction muffler 230 or may be introduced into the space 224 of the suction guide 220.

The space 224 of the suction guide 220 may communicate with an accommodation space 101 inside the casing 110, and thus the refrigerant gas suctioned through the suction pipe 210 may be introduced into the accommodation space 101.

A spaced space may be defined between the suction guide 220 and the suction muffler 230, and the refrigerant gas may be introduced into or discharged from the spaced space.

For example, the refrigerant gas in the space 224 inside the suction guide 220 may be introduced into the accommodation space 101 through the spaced space between the suction guide 220 and the suction muffler 230, or the refrigerant gas in the accommodation space 101 may be introduced into the space 224 of the suction guide 220 to flow into the suction muffler 230 through the spaced space between the suction guide 220 and the suction muffler 230.

As described above, the refrigerant gas inside the casing 110 has a temperature greater than that of the refrigerant gas suctioned through the suction pipe 210. Thus, when the refrigerant gas in the accommodation space 101 is introduced into the suction space 102 through the suction muffler 230, compression efficiency may be deteriorated.

However, in the suction structure 200 according to the first embodiment, the refrigerant gas suctioned through the suction pipe 210 may be primarily filled in the space 224 inside the suction guide 220, and the space 224 inside the suction guide 220 may be insulated from the accommodation space 101 by the body portion 221 of the suction guide 220.

That is, even if the space 224 inside the suction guide 220 communicates with the accommodation space 101 through a gap between the suction guide 220 and the suction muffler 230, the refrigerant gas inside the suction guide 220 may have a temperature less than that of the refrigerant gas inside the accommodation space 101.

For example, the body portion 221 of the suction guide 220 may be made of a material having low thermal conductivity.

For another example, the body portion 221 of the suction guide 220 may be surrounded by an insulating material. The insulating material may be attached to an outer or inner circumferential surface of the body portion 221.

For another example, the body portion 221 may be provided as a double wall, and a vacuum insulating layer may be provided inside the double wall.

The suction muffler 230 may have an inlet portion through which the refrigerant suctioned through the suction pipe 210 is introduced. An outlet portion through which the refrigerant is discharged may be provided at the suction pipe 210. The inlet portion of the suction muffler may be disposed adjacent to the outlet portion of the suction pipe 210.

The refrigerant suctioned through the suction pipe 210 may be discharged from the outlet portion of the suction pipe 210 to flow into the suction space 102 through the inlet portion of the suction muffler 230. For example, the inlet portion of the suction muffler 230 may be disposed to be spaced apart from the outlet portion of the suction pipe 210 in the axial direction. An inner diameter of the inlet portion of the suction muffler 230 may be provided greater than an outer diameter of the outlet portion of the suction pipe 210. Thus, the refrigerant gas of the space 224 of the suction guide 220 may be mixed into the space between the suction pipe 210 and the suction muffler 230.

When explaining a reason in which the mixing of the refrigerant gas is required, since the refrigerant of the suction space 102 moves to the compression space through the suction port 154 while the piston 150 rapidly repeats a compression stroke and a suction stroke, a predetermined amount of refrigerant gas has to be continuously filled into the suction space 102.

However, a sufficient amount of refrigerant gas may not be filled for a predetermined time only by supplying the refrigerant gas through the suction pipe 210 of the narrow passage. For this, it is necessary to supplementally suction the refrigerant gas around the suction pipe 210 and fill the suction space 102 with the refrigerant gas.

That is, the refrigerant gas may be supplemented through the spaced space between the inlet portion of the suction muffler 230 and the outlet portion of the suction pipe 210. However, as described above, since the refrigerant gas in the space 224 inside the suction guide 220 is maintained at a low temperature (substantially the same temperature as the refrigerant in the suction pipe 210), it may not adversely affect the compression efficiency.

The suction muffler 230 may be disposed to pass through a back cover 123. That is, the back cover 123 may provide a through-hole that is capable of accommodating the suction muffler 230 therein. An inner diameter of the through-hole of the back cover 123 may be provided greater than an outer diameter of the suction muffler 230.

Also, when compared to the related art, the suction structure 200 according to an embodiment may not include a separate connection guide (see 124 in FIG. 2) between the suction guide 220 and the suction muffler 230. That is, in the suction structure 200 according to an embodiment, since the suction guide 220 and the suction muffler 230 are disposed adjacent to each other, a separate connection guide may not be required. Thus, the whole length of the compressor 100 may be reduced. Therefore, it may meet the technology trend of miniaturizing the compressor 100.

Figure 6:
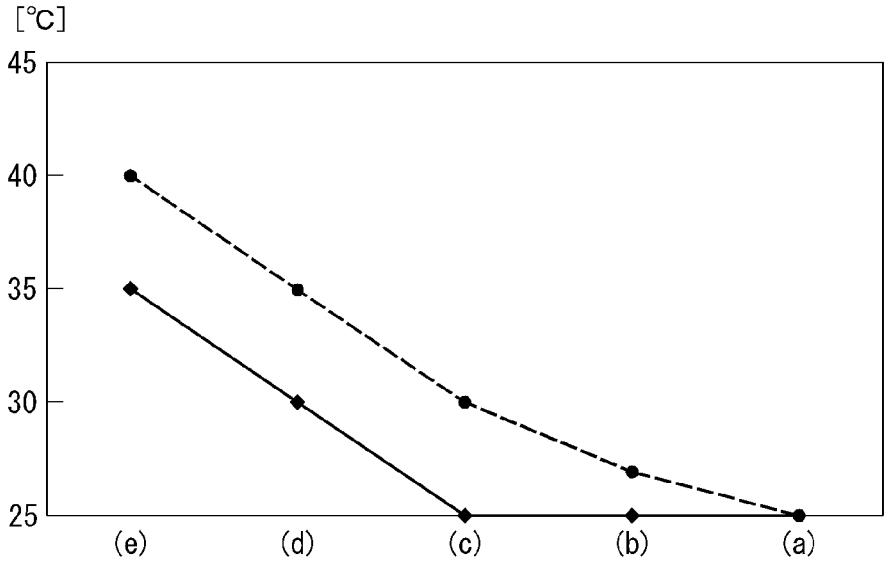
FIG. 6 is a view illustrating a temperature path of a refrigerant suctioned in FIG. 4.

FIG. 6 is a view illustrating a temperature path of the refrigerant suctioned in FIG. 4. In FIG. 6, a solid line is a diagram illustrating a temperature of the refrigerant suctioned in FIG. 4 along a path, and a dotted line is a diagram illustrating a temperature of the refrigerant suctioned in FIG. 2 along a path as illustrated in FIG. 3.

Referring to FIG. 6, since a refrigerant gas (point a in FIGS. 4 and 5) in a suction pipe 210 is suctioned at a temperature of about 25 degrees, an outlet portion (point b in FIGS. 4 and 5) of the suction pipe 210 and an inlet portion of the suction muffler 230 are disposed close to each other, and the refrigerant gas (point c in FIGS. 4 and 5) mixed between the suction pipe 210 and the suction muffler 230 is maintained at a temperature about 25 degrees, the refrigerant gas of the inlet portion of the suction muffler 230 may also be maintained at a temperature of about 25 degrees.

Thus, when compared to the graph illustrated in FIG. 3, the temperature of the refrigerant gas introduced into the inlet portion of the suction muffler 230 may be reduced by about 5 degrees. Thereafter, it is the same in that the temperature increases while passing through the suction muffler 230 and the inner guide 232 (point d in FIGS. 4 and 5), and the temperature increases until the refrigerant gas passes through the suction port 154 (point e in FIGS. 4 and 5).

As a result, when comparing the temperature of the refrigerant gas in the suction space 102 before being introduced into the compression space 103, in the suction structure of the compressor 100 according to Comparative Example, the refrigerant gas having a temperature of about 35 degrees is accommodated in the suction space 102, but in the suction structure 200 according to an embodiment, the refrigerant gas having a temperature of about 30 degrees is accommodated in the suction space 102.

That is, as the temperature of about 5 degrees decreases, a larger amount of refrigerant gas may be filled in the same volume, and thus a mass of the refrigerant compressed by one stroke may increase.

Figure 7:
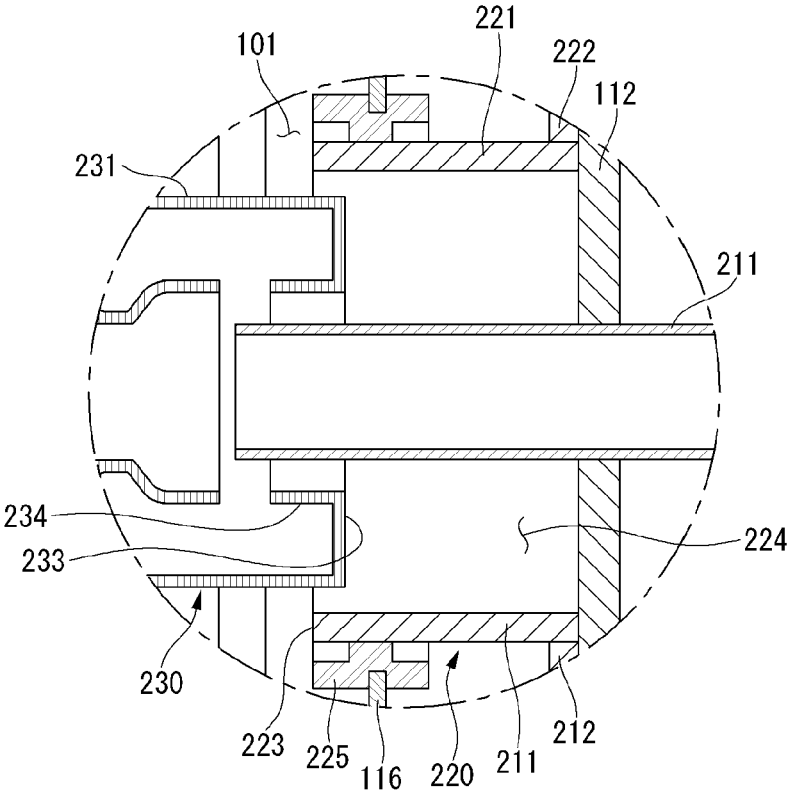
FIG. 7 is a cross-sectional view illustrating a modified example of a suction pipe having a different length.

FIG. 7 is a cross-sectional view illustrating a modified example of a suction pipe 210 having a different length.

In the modified embodiment, an outlet portion of a suction guide 220 may be disposed inside a suction muffler 230.

In detail, a suction pipe 210 through which a refrigerant gas is suctioned may pass through a first shell cover 112 and be accommodated in the suction guide 220 to extend in an axial direction and then may extend to the inside of the suction muffler 230.

The suction muffler 230 may be inserted into the suction guide 220 so that a rear end 233 of the suction muffler 230 is disposed behind a front end 223 of the suction guide 220.

The suction muffler 230 may further include an extension pipe 234 disposed at an inlet portion of the suction muffler 230. The extension pipe 234 may extend inward from a rear end 233 of the suction muffler 230.

An inner diameter of the extension pipe 234 may be provided larger than an outer diameter of the suction pipe 210.

The suction pipe 210 may be disposed so that a front end portion that is an outlet-side end portion of the suction pipe 210 is disposed on the same plane as an end portion of the extension pipe 234 of the suction muffler 230 or protrudes forward from the end portion of the extension pipe 234 of the suction muffler 230.

The suction pipe 210 may be disposed to be spaced apart from the extension pipe 234. That is, the refrigerant may be introduced through a space between an outer circumferential surface of the suction pipe 210 and an inner circumferential surface of the extension pipe 234.

Therefore, the refrigerant gas discharged from the suction pipe 210 may be introduced into the suction space 102 through the suction muffler 230 without leaking to the outside. In addition, if the supply of the refrigerant gas through the suction pipe 210 is insufficient during a suction stroke, a refrigerant gas that is in a low-temperature state in the space 224 of the suction guide 220 may be mixed into a spaced space between the suction pipe 210 and the extension pipe 234 of the suction muffler 230.

Figure 8:
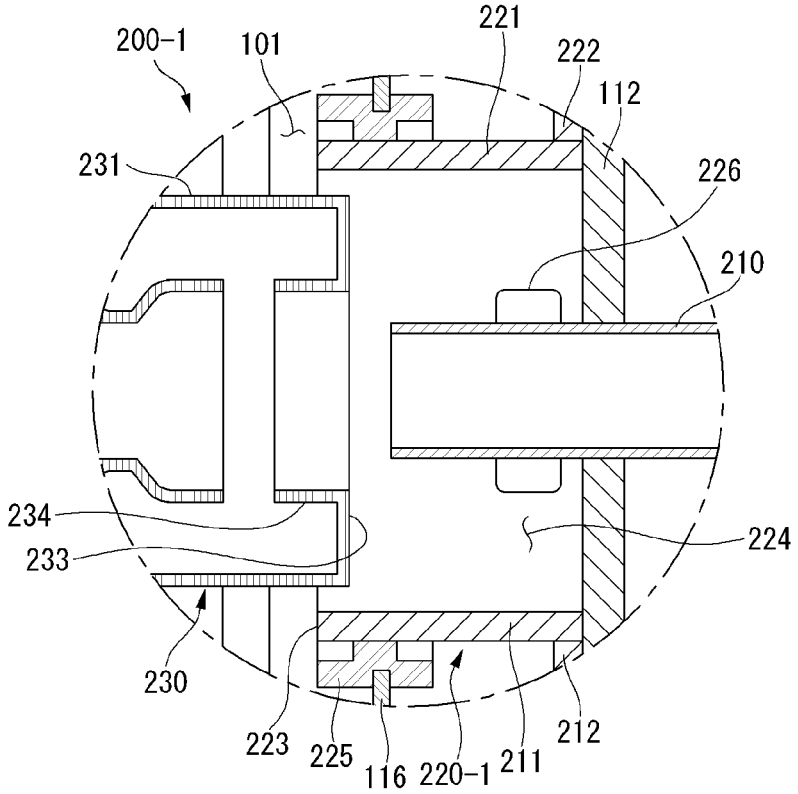
FIG. 8 is a cross-sectional view illustrating a suction structure of a compressor according to another embodiment.
Figure 9:
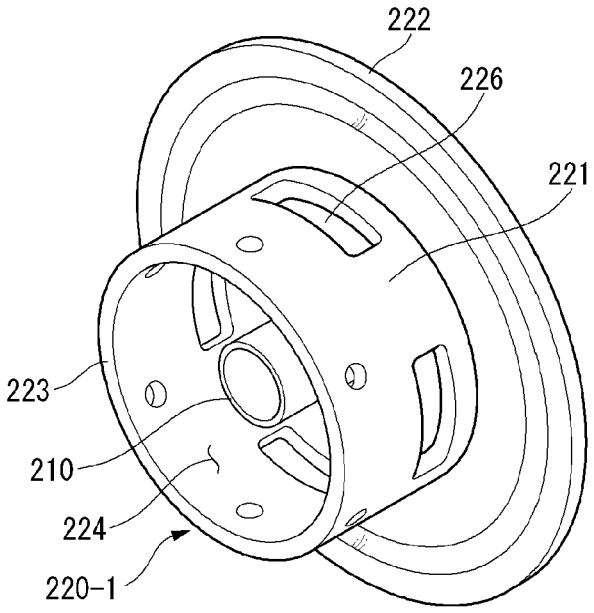
FIG. 9 is a perspective view illustrating a suction guide of FIG. 8.

FIG. 8 is a cross-sectional view illustrating a suction structure 200-1 of a compressor according to another embodiment, and FIG. 9 is a perspective view illustrating a suction guide 220-1 of FIG. 8.

In the suction guide 220-1 of a compressor according to another embodiment, a communication opening 226 communicating with an accommodation space 101 inside a casing 110 may be defined. The communication opening 226 may be defined in an outer circumferential surface of a body portion 221 of the suction guide 220-1.

The communication opening 226 may be disposed closer to a first shell cover 112 than a front end portion 223 of an outer circumferential surface of the body portion 221.

During a suction stroke of a piston 150, it has been described that since it is difficult to fill the suction space 102 with only the refrigerant gas suctioned through a suction pipe 210, the mixing of the refrigerant gas of the space 224 inside the suction guide 220-1 is required. However, in some cases, it may be difficult to fill the suction space 102 only by mixing the refrigerant gas in the space 224 inside the suction guide 220-1.

In this case, the refrigerant gas inside the accommodation space 101 through the communication opening 226 defined in the suction guide 220-1 is introduced into the space 224 inside the suction guide 220-1 to supplement an insufficient amount.

The communication opening 226 may be provided in plurality along a circumferential direction in an outer circumferential surface of a body portion 221 of the suction guide 220-1. The plurality of communication openings 226 may be disposed in the outer circumferential surface of the body portion 221 at equal intervals in the circumferential direction.

The communication opening 226 may be disposed adjacent to a first shell cover 112. The refrigerant gas inside the casing 110 may have temperatures different from each other for each portion. Particularly, the refrigerant gas around the first shell cover 112 may have a temperature less than that of each of other portions. Therefore, when the communication opening 226 is disposed adjacent to the first shell cover 112, the refrigerant gas around the first shell cover 112, which has a relatively low temperature, may be introduced through the communication opening 226 to prevent compression efficiency from being deteriorated.

Figure 10:
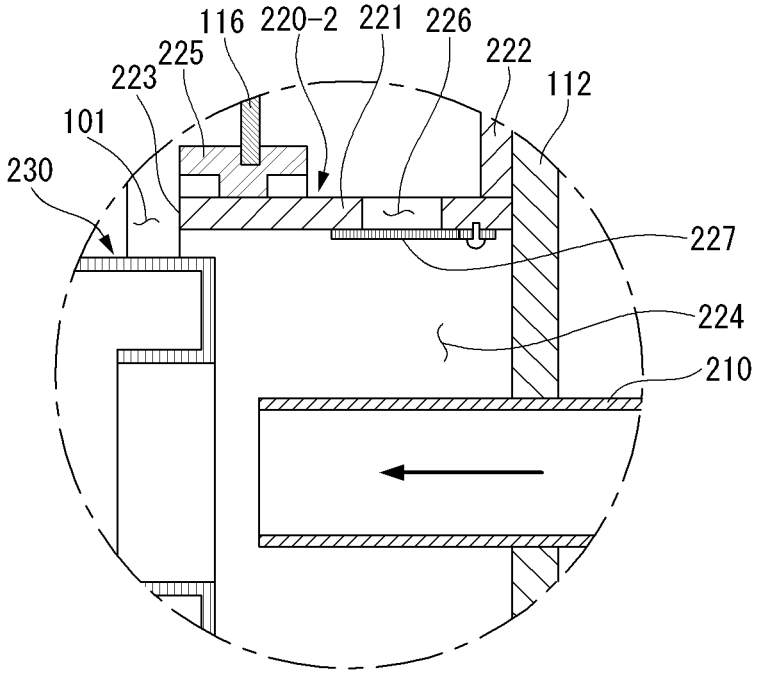
FIG. 10 is a view for explaining a modified example of the suction guide.
Figure 10:
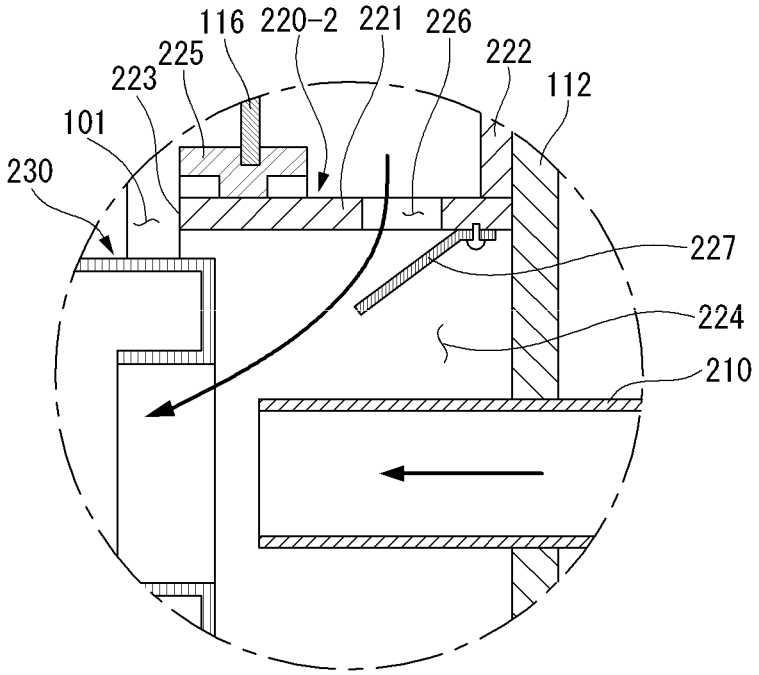

FIG. 10 is a view for explaining a modified example of the suction guide.

A suction guide 220-2 according to another embodiment may further include a valve member 227 capable of selectively opening or closing a communication opening 226.

The valve member 227 may be installed on an inner circumferential surface of the suction guide 220-2.

In detail, one side of the valve member 227 may be attached to one side of the communication opening 226, and the other side of the valve member 227 may be provided to cover the communication opening 226. The valve member 227 may be provided to be deformable. Thus, the valve member 227 may be deformed during a suction stroke to open the communication opening 226 and be restored to its original shape during a compression stroke to close the communication opening 226.

The valve member 227 may be fixed to a rear side of the communication opening 226 and be opened in a front direction of the communication opening 226. Since a refrigerant gas in the accommodation space 101 introduced through the communication opening 226 moves forward, the valve member 227 may be opened forward to guide the refrigerant gas introduced through the communication opening 226 forward.

Referring to (a) of FIG. 10, the valve member 227 is maintained in a state of blocking the communication opening 226 during the compression stroke or when a negative pressure is not generated in the suction guide 220-2.

Referring to (b) of FIG. 10, during the suction stroke, the refrigerant gas inside the suction guide 220-2 is mixed into the suction muffler 230, and a pressure inside the suction guide 220-2 is reduced to generate a negative pressure.

The refrigerant gas in the accommodation space 101 is introduced into a space 224 inside the suction guide 220-2 through the communication opening 226 due to the pressure difference between the outside and the inside of the suction guide 220-2. Here, the valve member 227 is elastically deformed by a fluid pressure to open the communication opening 226. The valve member 227 may be provided to be inclined forward in the open state to guide the refrigerant gas introduced through the communication opening 226 forward.

Some or other embodiments described above are not mutually exclusive or distinct. Some or other embodiments described above may have their respective configurations or functions, which are used together or combined with each other.

For example, it means that a configuration A described in a specific embodiment and/or a drawing may be combined with a configuration B described in another embodiment and/or a drawing. That is, even if the combination between the components is not directly described, the combination is possible except for the case where the combination is not described.

The detailed description is intended to be illustrative, but not limiting in all aspects. It is intended that the scope of the present disclosure should be determined by the rational interpretation of the claims as set forth, and the modifications and variations of the present disclosure come within the scope of the appended claims and their equivalents.

According to an embodiment, while the refrigerant suctioned through the suction pipe is introduced into the piston, the refrigerant inside the shell, which is in the relatively high-temperature state, may be prevented from being mixed to improve the compression efficiency.

Also, a portion of the refrigerant discharged from the suction pipe may be accommodated in the suction guide, and thus the mixed refrigerant may be maintained at the relatively low-temperature state.

Also, according to at least one of the embodiments, the communication opening communicating with the inner space (the accommodation space) of the shell of the suction guide may be defined so that the refrigerant of the inner space of the well is introduced into the suction space defined in the piston during the suction stroke, thereby supplementing the insufficient amount of refrigerant in the suction space.

In addition, according to at least one of the embodiments, the length of the compressor may be shortened by allowing the suction muffler and the suction pipe to be disposed adjacent to each other.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A compressor comprising:

a casing;

a cylinder disposed in the casing;

a piston that is disposed in the cylinder, that is configured to reciprocate in an axial direction, and that defines a suction space for receiving a refrigerant;

a suction muffler that is connected to the piston and configured to guide the refrigerant to the suction space;

a suction guide that is fixed to the casing and disposed parallel to the suction muffler in the axial direction; and a suction pipe that extends through the casing into the suction guide and that is configured to suction the refrigerant, wherein at least a portion of the suction muffler overlaps with at least a portion of the suction guide in a direction that traverses the axial direction, wherein a portion of the suction muffler is received in the suction guide, and wherein an outlet of the suction pipe is disposed in the suction guide.

2. The compressor according to claim 1, further comprising:

a main body comprising the cylinder, the piston, and a driving unit that is configured to drive the piston; and a support spring that supports the main body, wherein the support spring at least partially surrounds the suction guide.

3. The compressor according to claim 2, wherein the casing further comprises:

a shell that receives the main body and the support spring, and that has a cylindrical shape; and a shell cover that covers an end of the shell, wherein the shell defines an accommodation space that is configured to receive a portion of the refrigerant that is discharged from the suction pipe, wherein the suction guide receives the refrigerant that is discharged from the suction pipe, and wherein a space is defined between the suction guide and the suction muffler and is configured to introduce the refrigerant of the accommodation space into the suction guide.

4. The compressor according to claim 3, wherein the suction guide comprises:

a body portion that has a tubular shape and that extends in the axial direction; and a fixed portion that extends radially outward from the body portion and that is fixed to the shell cover, wherein the body portion defines a communication opening that fluidly communicates with the accommodation space of the shell.

5. The compressor according to claim 4, wherein the communication opening is disposed closer to the shell cover than to an end of the suction guide.

6. The compressor according to claim 4, wherein the suction guide further comprises a valve member that is configured to selectively open or close the communication opening.

7. The compressor according to claim 6, wherein the valve member has (i) a first side that is coupled to an inner circumferential surface of the body portion of the suction guide around the communication opening of the body portion, and (ii) a second side that is configured to open the communication opening to guide the refrigerant of the accommodation space that is suctioned through the communication opening.

8. The compressor according to claim 2, further comprising a back cover that has (i) a first side connected to the main body and (ii) a second side that is opposite to the first side and is supported by the support spring, wherein a through-opening is defined in a central portion of the back cover, and wherein the suction muffler extends through the through-opening.

9. The compressor according to claim 1, wherein the suction pipe extends adjacent to an end of the suction muffler.

10. The compressor according to claim 1, wherein a space is defined between the suction guide and the suction muffler and is configured to receive the refrigerant.

11. The compressor according to claim 1, wherein the suction muffler includes an end portion that has an outer circumferential surface having a first diameter, wherein the suction guide includes an opening that has an inner circumferential surface having a second diameter, wherein the suction guide extends in parallel with the suction muffler, and wherein the second diameter of the opening of the suction guide is greater than the first diameter of the end portion of the suction muffler.

12. The compressor according to claim 11, wherein the suction guide is disposed coaxially with the suction muffler.

13. The compressor according to claim 1, wherein the suction muffler defines an inlet that is configured to receive the refrigerant, wherein the suction pipe defines an outlet that is configured to discharge the refrigerant, and wherein the inlet of the suction muffler has an inner diameter that is greater than an outer diameter of the outlet of the suction pipe.

14. The compressor according to claim 13, wherein the outlet of the suction pipe is inserted into the suction muffler.

15. The compressor according to claim 13, wherein an end of the suction pipe is spaced apart from an end of the suction guide.

16. The compressor according to claim 15, wherein the suction muffler comprises an extension pipe that extends from an end of the suction muffler, and wherein the end of the suction pipe is aligned with an end of the extension pipe or spaced apart from the end of the extension pipe.

17. The compressor according to claim 1, wherein the suction guide defines a space that is configured to receive a portion of the refrigerant that is discharged from the suction pipe, and wherein, based on a suction stroke of the piston, the portion of the refrigerant within the space is mixed with the refrigerant of the suction muffler.

18. The compressor according to claim 17, wherein the suction guide comprises:

a body portion that has a tubular shape and that extends in the axial direction; and a fixed portion that extends radially outward from the body portion and is fixed to the casing, wherein the body portion comprises an insulating material.

19. The compressor according to claim 1, wherein the suction guide is disposed opposite to the suction space with respect to the suction muffler.

* * * * *